US008235371B2

(12) United States Patent
Taguchi et al.

(10) Patent No.: US 8,235,371 B2
(45) Date of Patent: Aug. 7, 2012

(54) SHEET FINISHING APPARATUS AND SHEET FINISHING METHOD

(75) Inventors: Hiroyuki Taguchi, Shizuoka-ken (JP); Katsuya Sasahara, Shizuoka-ken (JP); Shinichiro Mano, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/040,899

(22) Filed: Mar. 4, 2011

(65) Prior Publication Data

US 2011/0218091 A1 Sep. 8, 2011

Related U.S. Application Data

(60) Provisional application No. 61/311,246, filed on Mar. 5, 2010, provisional application No. 61/311,245, filed on Mar. 5, 2010, provisional application No. 61/311,248, filed on Mar. 5, 2010.

(51) Int. Cl.
*B65H 37/04* (2006.01)

(52) U.S. Cl. ..... 270/45; 270/51; 270/58.07

(58) Field of Classification Search ..... 270/37, 270/45, 51, 58.04, 58.07
See application file for complete search history.

(56) References Cited

U.S. PATENT DOCUMENTS

| | | | | |
|---|---|---|---|---|
| 6,905,118 | B2 * | 6/2005 | Yamada et al. | 270/8 |
| 7,562,866 | B2 * | 7/2009 | Hayashi | 270/58.07 |
| 2010/0009830 | A1 * | 1/2010 | Dobashi et al. | 493/454 |

* cited by examiner

*Primary Examiner* — Leslie A Nicholson, III
(74) *Attorney, Agent, or Firm* — Patterson & Sheridan, LLP

(57) ABSTRACT

According to an embodiment, there is provided a sheet finishing apparatus including a folding roller that nips the middle of bundle of sheets and forms a fold line, a fold reinforcing roller that reinforces the fold line by moving along the fold line while applying a pressure to the fold line, a stack tray that stacks the bundle and a control unit that sets the number of times of fold reinforcing performed by the fold reinforcing roller as a first number when it is determined that a quantity of stacked bundle on the stack tray is less than a predetermined standard quantity which is set to be less than a maximum stack quantity and sets the number of times of the fold reinforcing as a second number greater than the first number when it is determined that a quantity of the stacked bundle is greater than the predetermined standard quantity.

20 Claims, 19 Drawing Sheets

SHEET FINISHING APPARATUS AND SHEET FINISHING METHOD

CROSS-REFERENCE TO RELATED APPLICATION

This application is based upon and claims the benefit of priority from: U.S. provisional applications 61/311,246 filed on Mar. 5, 2010, 61/311,245 filed on Mar. 5, 2010, and 61/311,248 filed on Mar. 5, 2010, the entire contents of each of which are incorporated herein by reference.

FIELD

Embodiments described herein relate generally to a sheet finishing apparatus and sheet finishing method.

BACKGROUND

Conventionally, a sheet finishing apparatus that is disposed at a lower side of image forming apparatuses such as a copy machine, a printer, a multi-functional peripheral (MFP) or the like and forms a booklet by finishing such as folding or stapling printed sheets of paper is known.

In the folding, the middle of a bundle of paper is pressed by a nip of a pair of folding rollers and a fold is formed thereon. Then, a roller called a fold reinforcing roller moves along the fold while applying a pressure to the fold, thereby reinforcing the fold.

A sheet stack unit (a stack tray) that stacks a plurality of formed booklets is provided in the sheet finishing apparatus. Regarding the bundles of paper in which the fold is reinforced, the booklets which are consecutively discharged from a discharge port of the sheet finishing apparatus are stacked in order on the sheet stack unit.

Since the volume near the fold swells when the fold reinforcement is not sufficient, the thickness of booklets increases. Therefore, even with booklets having the same number of pages, the quantity of booklets which can be stacked on the sheet stack unit decreases, when compared to the quantity of booklets of which the folds are sufficiently reinforced.

Meanwhile, the swelled volume near the fold can be decreased by increasing the number of times of fold reinforcing. For example, by increasing the number of times of the fold reinforcing, which usually reciprocates once along the fold, to two times or more, the fold is sufficiently reinforced and the volume near the fold becomes thin. Thus it is advantageous when stacking a large quantity of booklets on the sheet stack unit. However, if the number of times of the fold reinforcing is increased, the required time for forming one booklet naturally increases and overall throughput is lowered.

For these reasons, there is a demand for a sheet finishing apparatus and a sheet finishing method which can achieve a balance between the quantity of stacked booklets on the sheet stack unit and the throughput.

DETAILED DESCRIPTION

An embodiment of a sheet finishing apparatus and a sheet finishing method will be described with reference to the accompanying drawings.

The sheet finishing apparatus according to the embodiment includes a folding roller that nips the middle of bundle of sheets and forms a fold line, a fold reinforcing roller that reinforces the fold line by moving along the fold line while applying a pressure to the fold line, a stack tray that stacks the bundle and a control unit that sets the number of times of fold reinforcing performed by the fold reinforcing roller as a first number when it is determined that a quantity of stacked bundle on the stack tray is less than a predetermined standard quantity which is set to be less than a maximum stack quantity and sets the number of times of the fold reinforcing as a second number greater than the first number when it is determined that a quantity of the stacked bundle is greater than the predetermined standard quantity.

(1) Configuration

Figure 1:
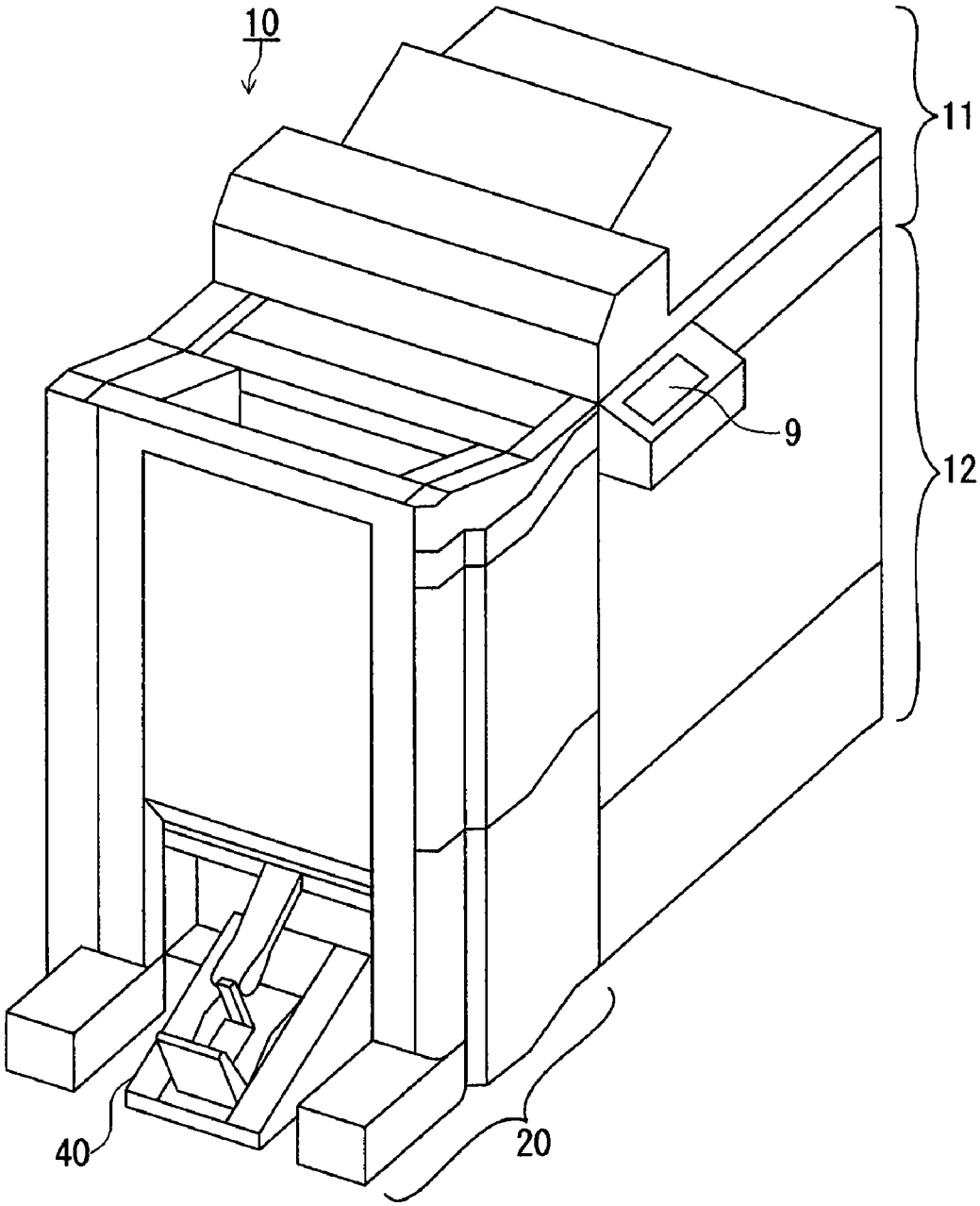
FIG. 1 is a perspective view illustrating an exterior example of an image forming apparatus including a sheet finishing apparatus of the present embodiment.

FIG. 1 is an exterior perspective view illustrating an example of a basic configuration of an image forming apparatus 10 including a sheet finishing apparatus 20 according to a first embodiment. The image forming apparatus 10 is configured of a readout unit 11 which reads documents, an image forming unit 12 which prints image data of the read documents to sheets of paper using an electrophotographic system, and the sheet finishing apparatus 20 which performs the finishing such as sorting, punching, folding and stapling with respect to the printed sheets. In addition, the image forming unit 12 includes an operation unit 9 for performing various user operations.

Figure 2:
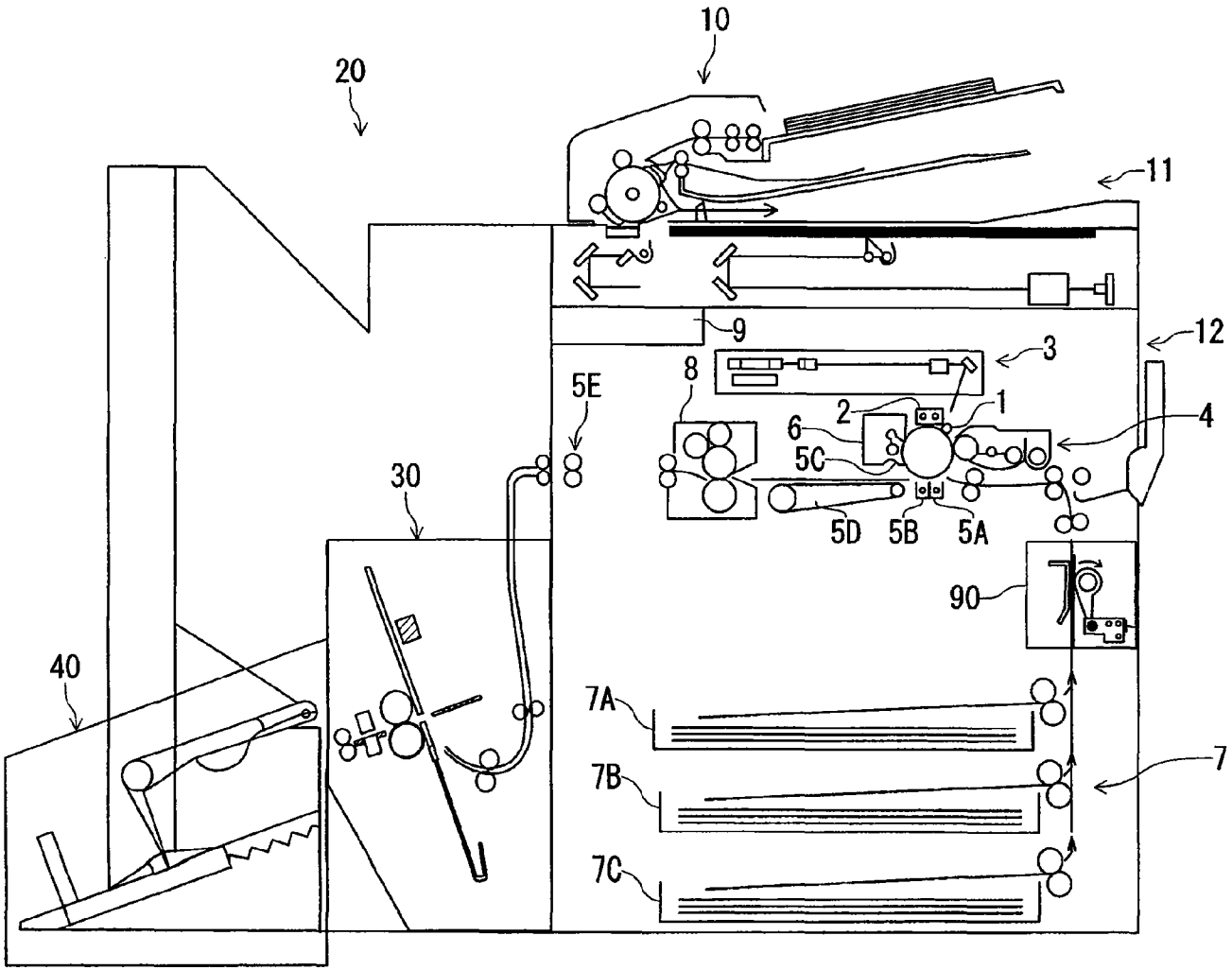
FIG. 2 is a cross sectional view illustrating a configuration example of the image forming apparatus.

FIG. 2 is a cross sectional view illustrating a detailed configuration example of the image forming apparatus 10.

The image forming unit 12 of the image forming apparatus 10 has a photoconductive drum 1 in the middle thereof and in a periphery of the photoconductive drum 1, a charging unit 2, an exposure unit 3, a developing unit 4, a transferring unit 5A, a charge removing unit 5B, a separating claw 5C and a cleaning unit 6 are respectively provided. Moreover, a fixing unit 8 is provided at a lower side of the charge removing unit 5B. Generally, the image forming is performed by each of the units described above in the order below.

First, the charging unit 2 charges a surface of the photoconductive drum 1 uniformly. Meanwhile, the image data, to which the read documents by the readout unit 11 are converted, is input to the exposure unit 3. The exposure unit 3 irradiates laser beams in accordance with the level of the image data to the photoconductive drum 1 and forms an electrostatic latent image thereon. A toner supplied from the developing unit 4 develops the electrostatic latent image and a toner image is formed on the photoconductive drum 1.

The sheet of paper that is accommodated in a sheet accommodation unit 7 (7A, 7B and 7C) is transported up to a transferring position (a gap between the photoconductive drum 1 and the transferring unit 5A) by passing through a sheet thickness detection unit 90 via some transporting rollers. In the transferring position, the transferring unit 5A transfers the toner image to the sheet of paper from the photoconductive drum 1. The charge removing unit 5B eliminates charge of the surface of the sheet on which the toner image is transferred. The separating claw 5C separates the sheet from the photoconductive drum 1. Subsequently, the sheet is transported by an intermediate transporting unit 5D, heated by the fixing unit 8 and fixed with the toner image after being pressed. The sheet where the fixing is terminated is discharged from a discharging unit 5E and output to the sheet finishing apparatus 20.

The cleaning unit 6 disposed downstream of the separating claw 5C eliminates a developer which remains on the surface of the photoconductive drum 1 in preparation for next image forming.

The sheet finishing apparatus 20 includes a sheet folding device 30 and a sheet stacking unit 40 in addition to a sorting unit which sorts the sheet.

The sheet folding device 30 performs stapling in the middle of a couple of sheets discharged from the image forming unit 12 after printing is finished and forms a booklet by folding the middle of the sheet (middle-stapling). In some cases, middle-folded bundles of paper are stacked to the sheet stack unit 40 by simply middle-folding without stapling.

In the sheet folding device 30, the booklet which is processed by the middle-stapling and the middle-folding (or the middle-folding) is output to the sheet stack unit 40 and the booklet (a bundle of paper) is finally stacked here.

Figure 3:
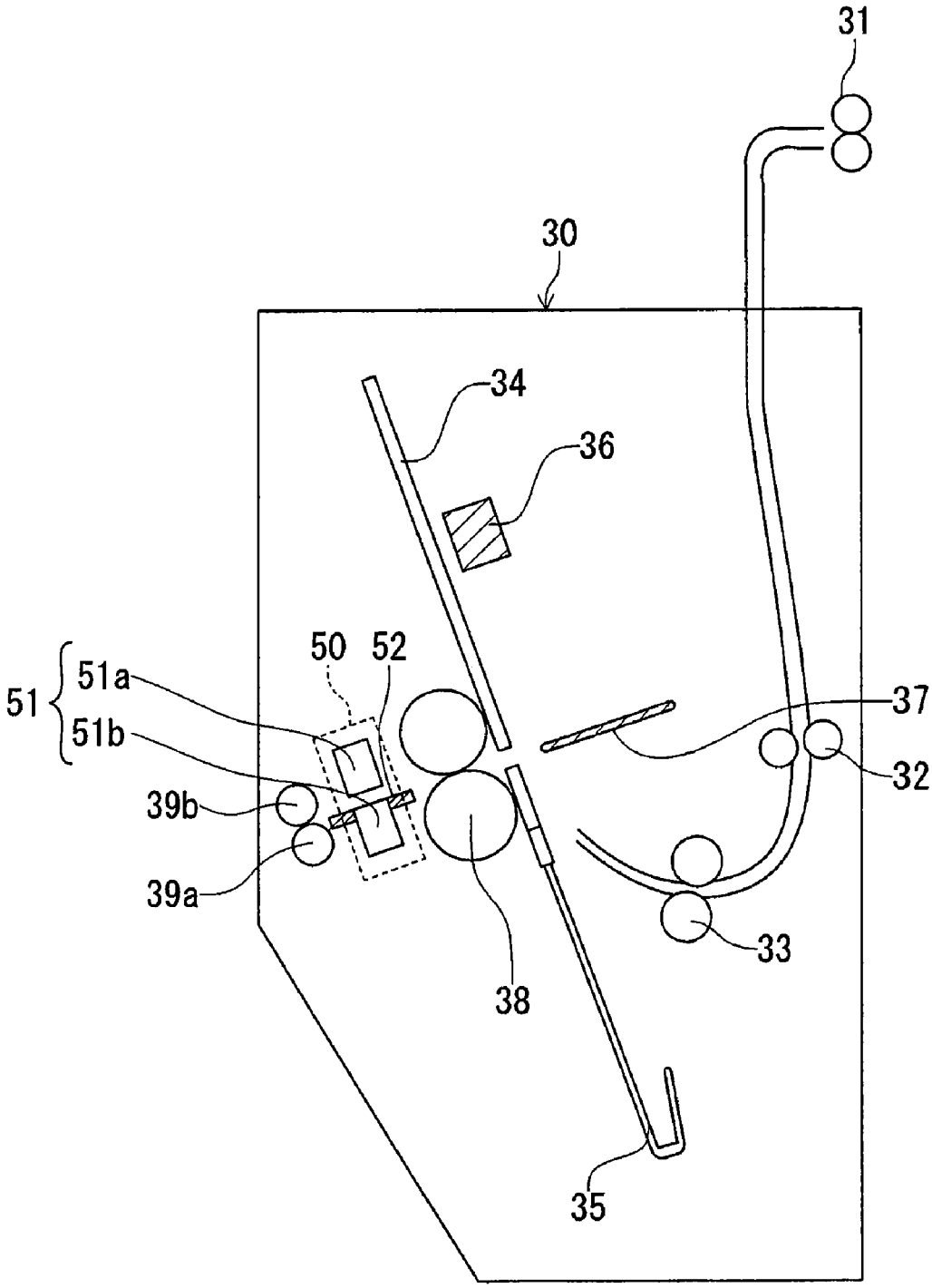
FIG. 3 is a cross sectional view illustrating a configuration example of the sheet finishing apparatus.

FIG. 3 is a cross sectional view illustrating a detailed configuration example of the sheet folding device 30.

The sheet folding device 30 receives the sheet discharged from the discharge unit 5E of the image forming unit 12 with a pair of inlet rollers 31 and delivers the sheet to a pair of intermediate rollers 32. The pair of intermediate rollers 32 further delivers the sheet to a pair of outlet rollers 33. The pair of outlet rollers 33 sends the sheet to a standing tray 34 having an oblique stacking surface. A leading edge of the sheet faces upward of the oblique surface of the standing tray 34.

At a lower side of the standing tray 34, a stacker 35 is on standby to receive the bottom edge of the sheet which slides down from the upper side of the oblique surface of the standing tray 34 after the sheet is switched back.

A stapler (middle-stapling unit) 36 is provided near the middle of the standing tray 34. When middle-stapling the bundles of paper (stapling), the position of the stacker 35 is adjusted so that the stapler 36 faces a position to be stapled of the bundles of paper (the center of the bundles of paper in a vertical direction).

After the bundles of paper are stapled by the stapler 36, the stacker 35 is lowered so as to adjust the position to be folded of the bundles of paper (in the middle of the bundles of paper in the vertical direction and a stapled position) until it is brought in front of a middle-folding blade 37.

When the position to be folded is brought in front of the middle-folding blade 37, a leading end 37*a* of the middle-folding blade 37 presses and input the surface to be an inner side after the bundles of paper is folded into the proceeding direction.

In front of a moving direction of the middle-folding blade 37, a pair of folding rollers 38 is provided. The bundles of paper pressed by the middle-folding blade 37 are nipped by a nip of the pair of folding rollers 38 and the fold line is formed in the middle thereon. A middle-folding unit is configured of the middle-folding blade 37 and the pair of folding rollers 38.

The bundles of paper on which the fold line is formed with the pair of folding rollers 38 are further transported to a fold reinforcing unit 50 provided at the downstream side of the middle-folding unit. The bundles of paper transported to the fold reinforcing unit 50 stop the transporting momentarily on a stack board 52.

In the fold reinforcing unit 50, fold reinforcing rollers 51 (a pair of rollers consisting of an upper roller 51*a* and a lower roller 51*b*) are provided. The fold reinforcing rollers 51 move while applying pressure in an orthogonal direction (a direction along the fold line) to the direction in which the bundles of paper are transported and reinforce the fold line.

The bundles of paper in which the fold line is reinforced with the fold reinforcing unit 50 restart the transporting and are output to the sheet stack unit 40 by a pair of discharging rollers 39*a* and 39*b*. Then the bundles of paper after middle stapling, that are the booklets, are consecutively stacked in the sheet stack unit 40.

Figure 4:
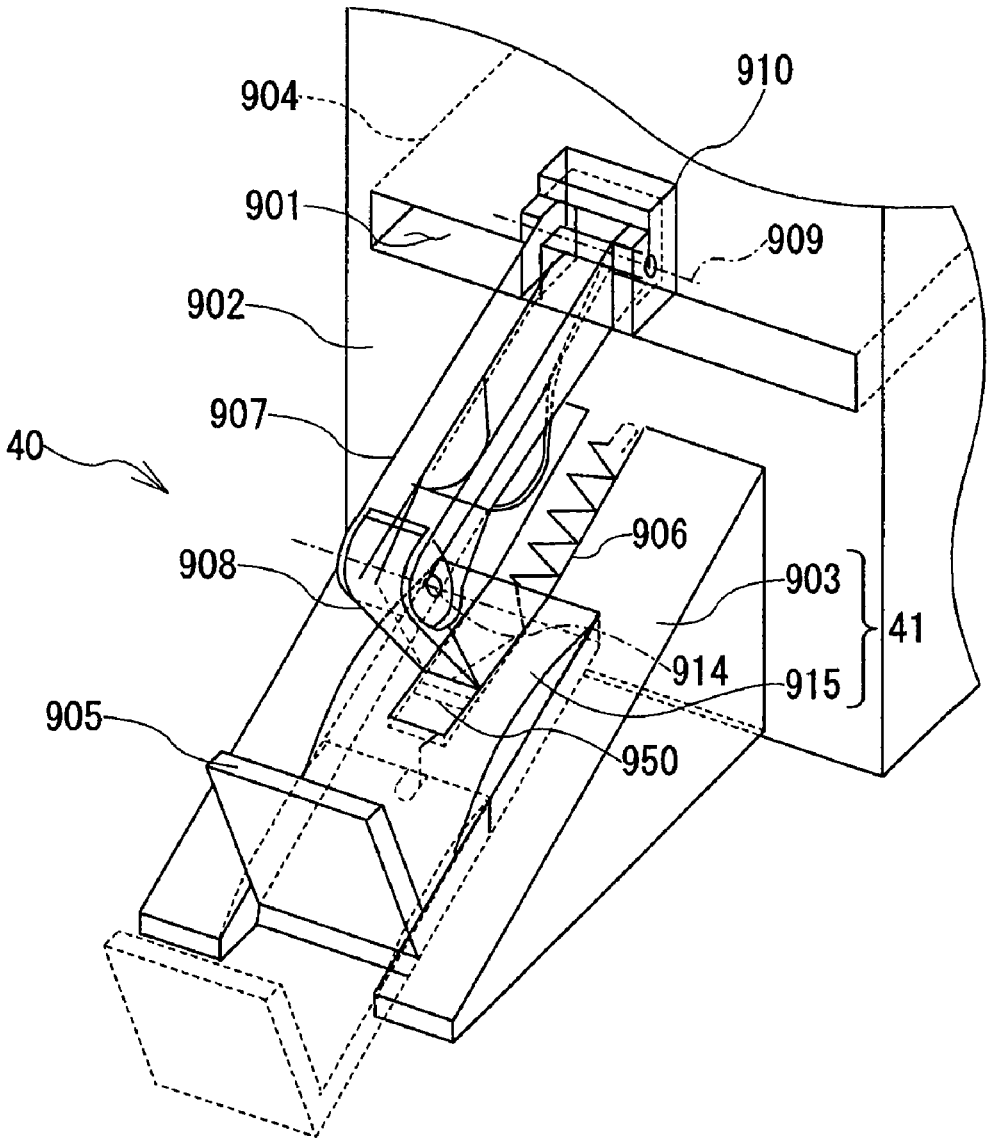
FIG. 4 is a perspective view illustrating an example of the exterior configuration of the sheet stack unit.

FIG. 4 is a diagram illustrating the sheet stack unit 40 of the sheet finishing apparatus 20.

The sheet stack unit 40 includes a bed 903, a base plate 915, an upper arm 907 and a forearm 908. At the leading edge of the base plate 915, an attachable and detachable guard 905 is installed.

The base plate 915 is connected to a side wall 902 of the main body of the sheet finishing apparatus 20 through a spring 906 and extends downward in an oblique state from the sidewall 902 of the main body with the bed 903. A stack tray 41 is configured of the base plate 915 and the bed 903 and stacks plural booklets (the bundles of paper) thereon, which are discharged sequentially from a discharge port 901 provided at the sidewall 902.

The base end of the upper arm 907 is supported so as to be able to rotate around a shaft 909 installed at a supporter 910 that is fixed to the side wall 902.

The leading end of the upper arm 907 has a shaft 914 and the upper end of the forearm 908 is supported to be able to rotate around the shaft 914.

A gentle hill portion is formed in the middle of the base plate 915 along the oblique direction and a flapper 950 is installed near the top of the hill portion. In addition, a groove is formed in the oblique direction of the flapper 950. The lower end of the forearm 908 is locked to the groove and the forearm 908 is nearly orthogonal to the stack side of the base plate 915.

Although the stacked booklet on the base plate 915 slides to the stack side of the bed 903 and the base plate 915 by its own weight, the leading edge of the booklet is stopped and received by the forearm 908.

Figure 5:
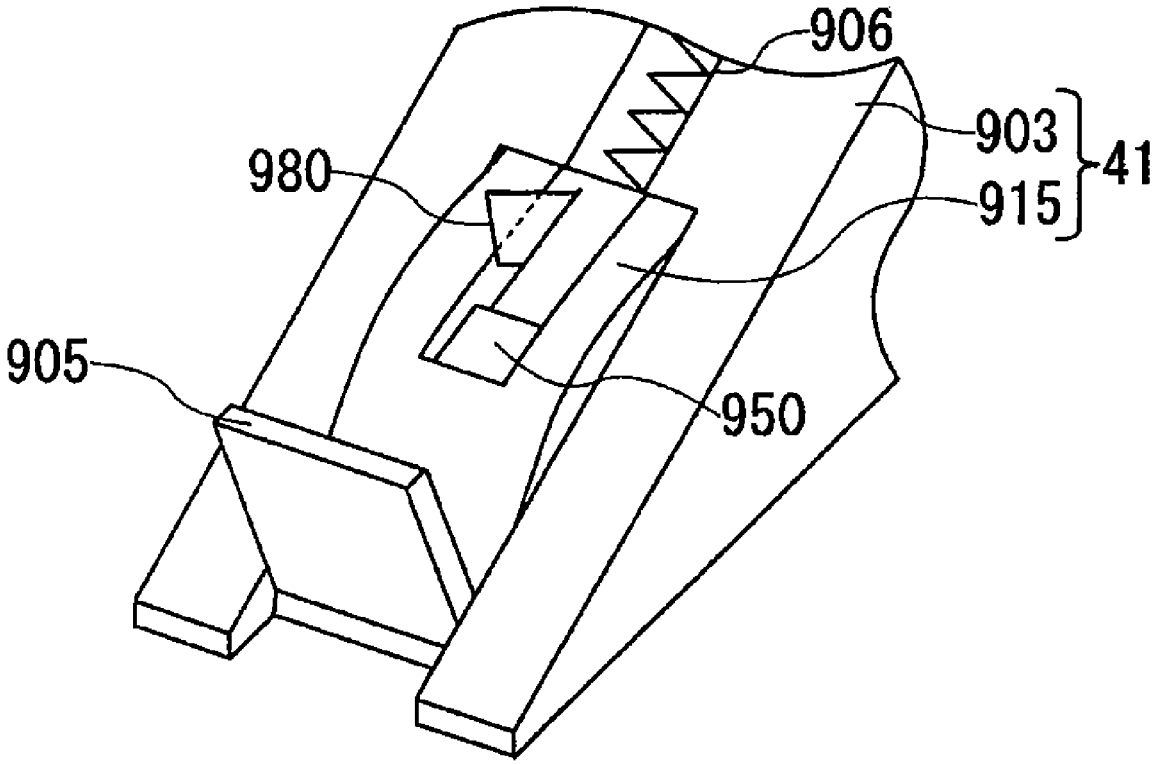
FIG. 5 is an overall perspective view illustrating the configuration of the sheet stack unit without an upper arm and a forearm.

FIG. 5 is a diagram illustrating a state where the upper arm 907 and the forearm 908 are removed from the sheet stack unit 40. A sheet sensor 42 which detects the booklet and has a detection lever 980 is accommodated inside the bed 903. As shown in FIG. 5, in a state where the booklet is not stacked on the base plate 915, the detection lever 980 is projected and exposed from the groove of the base plate 915. If there is at least one booklet on the base plate 915, the detection lever 980 is made to sink down by the weight of the booklet. The sheet sensor 42 can identify states in which the booklet is not stacked on the base plate 915 (non-stacked state) and in which one or more booklets are stacked thereon (stacked state) depending on the movements of the detection lever 980.

Figure 6:
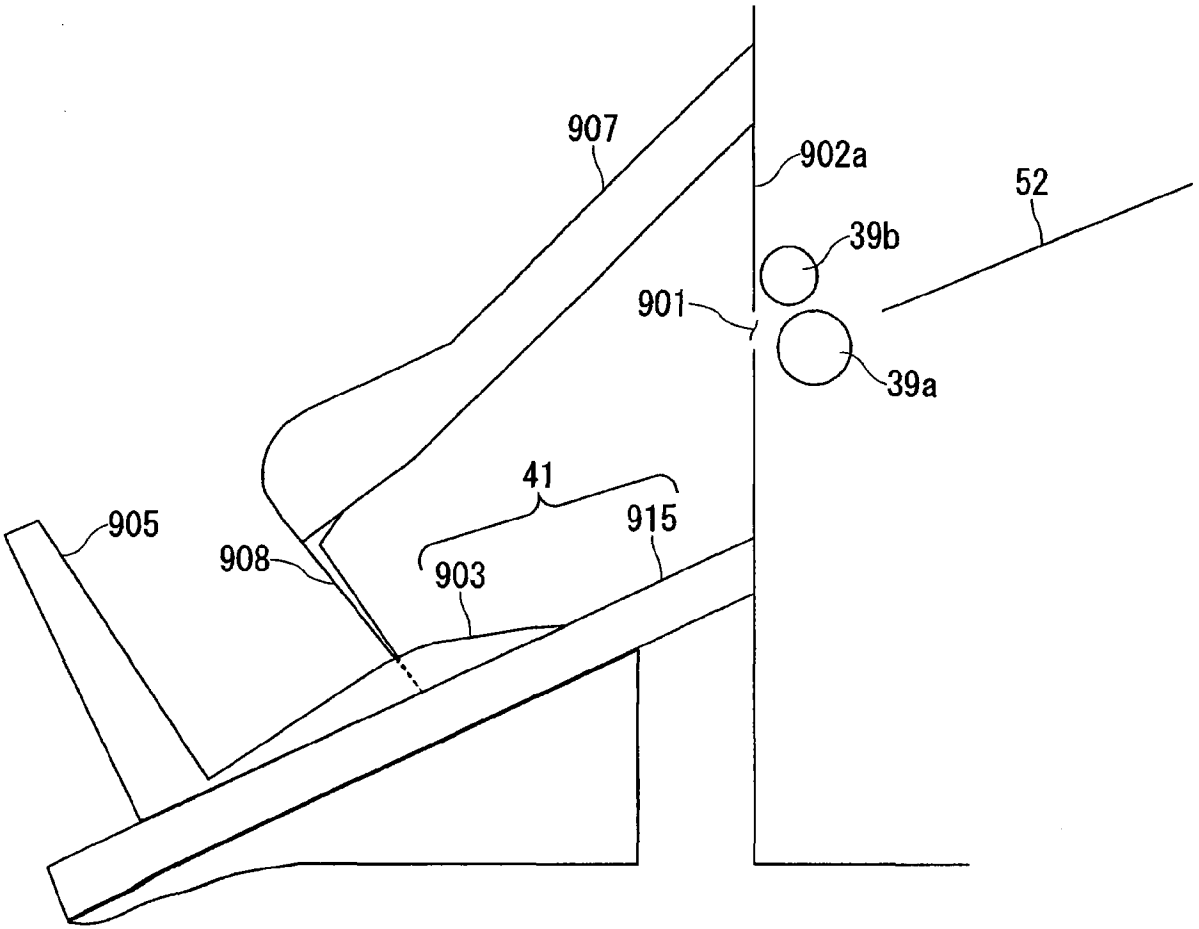
FIG. 6 is a schematic view illustrating a part of the sheet stack unit and a main body of the sheet finishing apparatus when seen from the front direction of the image forming apparatus.

FIG. 6 is a schematic view illustrating a part of a main body of the sheet finishing apparatus (hereinafter, simply referred as a main body) and the sheet stack unit 40 as seen from the front direction (a direction having the operation unit 9 in FIG. 1). As described above, the sheet stack unit 40 includes the stack tray 41 configured of the bed 903 and the base plate 915, the upper arm 907, the forearm 908 and the like. The bed 903 and the base plate 915 extend in an oblique direction from the sidewall 902 of the main body to the lower part and the plural booklets, discharged from the discharge port 901 provided at the sidewall, are stacked in order thereon. The guard 905 is installed at the lower end of the base plate 915.

The sidewall 902 of the main body includes the discharge port 901 and the pair of discharging rollers 39*a* and 39*b* is installed therein. The stack board 52 is installed in the inner side of the pair of discharging rollers 39*a* and 39*b*. The booklet of which the fold line is reinforced on the stack board 52 is transported toward the sheet stack unit 40 after being pressed by the pair of discharging rollers 39*a* and 39*b*.

(2) First Embodiment

Figure 7:
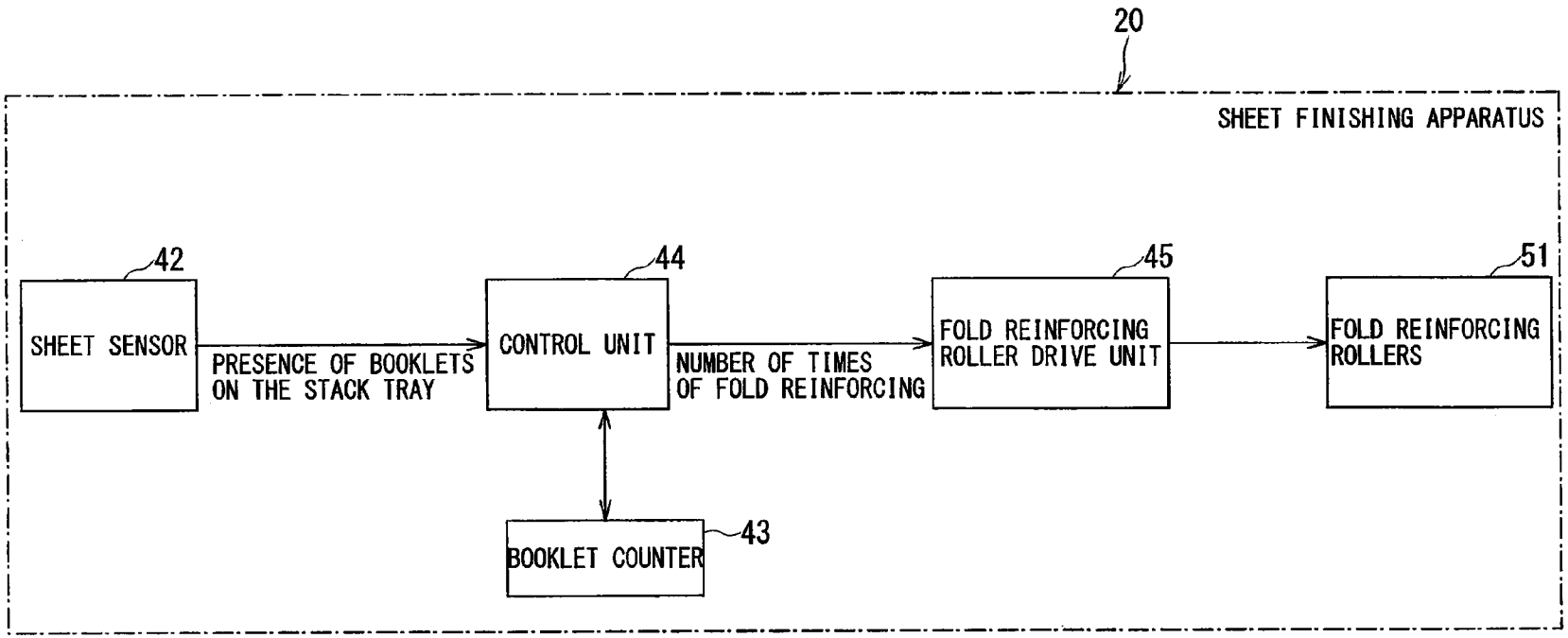
FIG. 7 is a function block diagram of the sheet finishing apparatus according to a first embodiment.

FIG. 7 is a function block diagram regarding a basic operation of the sheet finishing apparatus 20 according to a first embodiment. The sheet finishing apparatus 20 includes the sheet sensor 42, a booklet counter 43, a control unit 44, a fold reinforcing roller drive unit 45, the fold reinforcing rollers 51 and the like.

The sheet sensor 42 is provided in the stack tray 41 and detects the presence of the stacked bundles of paper in the stack tray 41. The booklet counter 43 counts the number of bundles of paper which are discharged toward the stack tray 41. The fold reinforcing roller drive unit 45 has a fold reinforcing motor and moves the fold reinforcing rollers 51 along the fold line of the bundles of paper using the fold reinforcing motor, thereby reinforcing the fold line.

The control unit 44 sets the number of times of fold reinforcing to be performed by the fold reinforcing rollers 51 as a first number when it is determined that a quantity of stacked bundles of paper on the stack tray 41 is less than a predetermined standard quantity which is set to be less than a maximum stack quantity, and sets the number of times of the fold reinforcing as a second number larger than the first number when it is determined that the quantity of the stacked bundles of paper is greater than the predetermined standard quantity. The predetermined standard quantity is, for example, about a half of the maximum stack number of the bundles of paper. The first number is, for example, one time and the second number is, for example, two times.

Figure 8B:
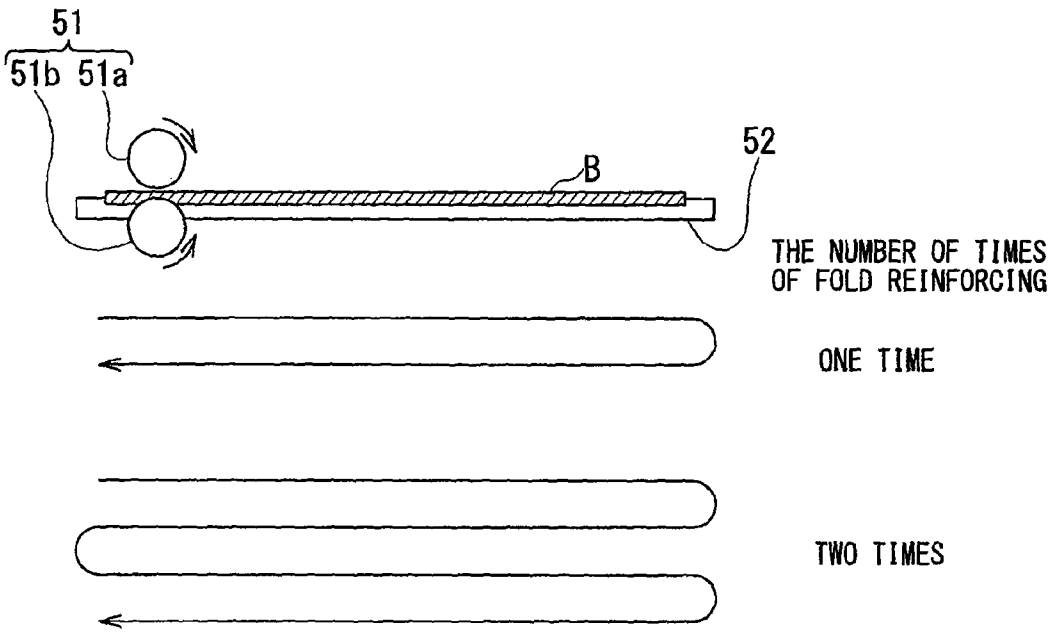
FIGS. 8A and 8B are first diagrams which describe a fold reinforcing process of the first embodiment.
Figure 8A:
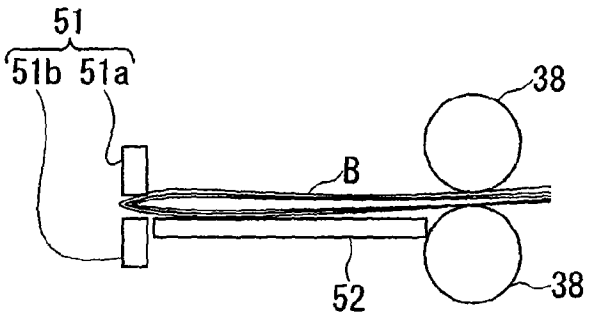

FIGS. 8A and 8B are diagrams schematically illustrating an outline of the fold reinforcing for a bundle of sheets. FIG. 8A is a diagram seen from the orthogonal direction to the transporting direction of the bundle of sheets and FIG. 8B is a diagram seen from the front of the transporting direction. As described above, the bundle of sheets B of which the fold line is formed thereon by the pair of folding rollers 38 proceed on the stack board 52 due to the pair of folding rollers 38 and momentarily stop when the fold line reaches the position of the fold reinforcing rollers 51 (FIG. 8A). Subsequently, as shown in FIG. 8B, the fold reinforcing rollers 51 reinforce the fold line of bundle of sheets B by moving along the fold line while applying pressure thereto. The number of times of the fold reinforcing is usually the number of times that the fold reinforcing rollers 51 reciprocate once along the fold line. Therefore, when the fold reinforcing rollers 51 reciprocate along the fold line once, the number of times of the fold reinforcing is counted as one time and when the fold reinforcing rollers 51 reciprocate along the fold line twice, the number of times of the fold reinforcing is counted as two times.

Figures 9A, 9B:
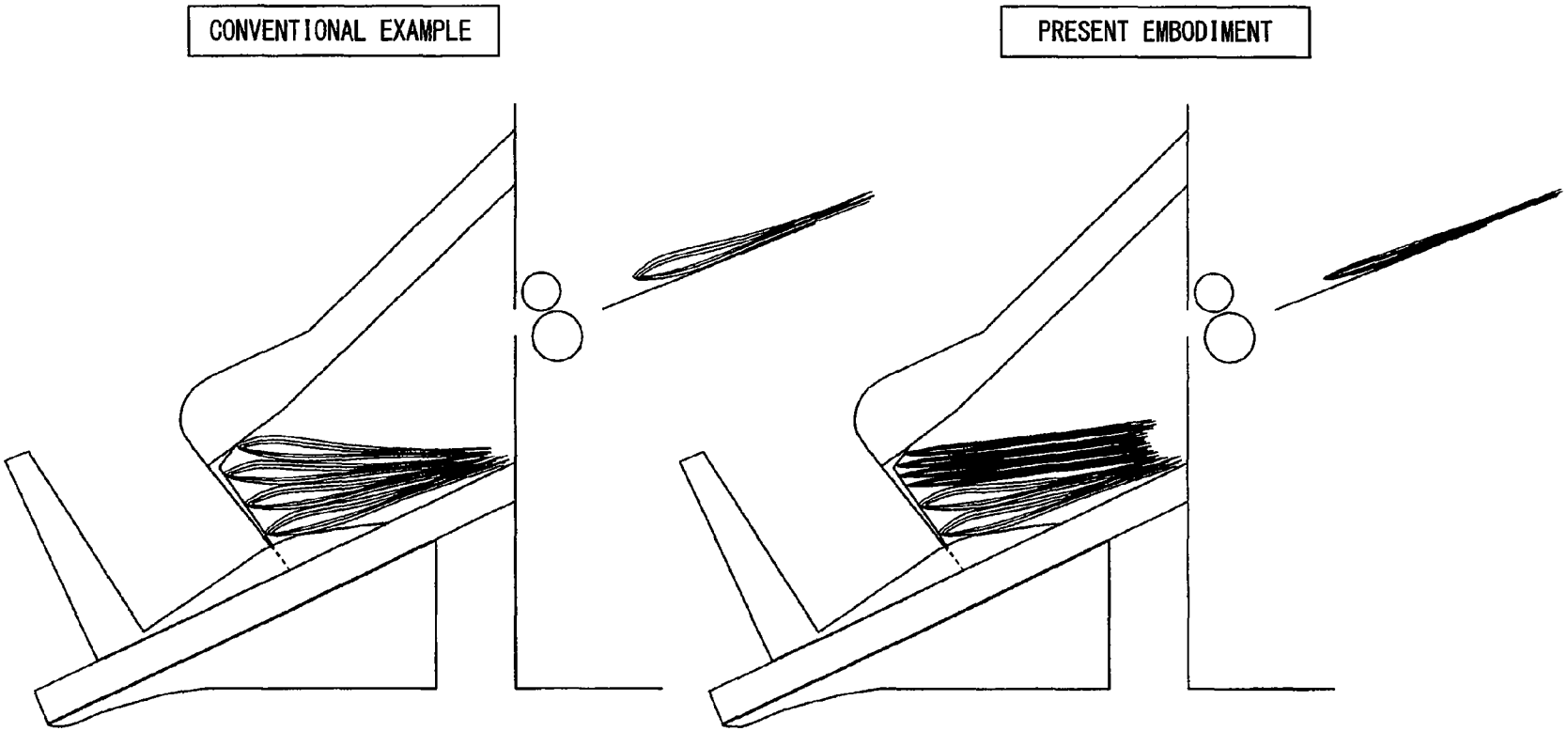
FIGS. 9A and 9B are second diagrams which describe the fold reinforcing of the first embodiment.

As shown in FIG. 9A, which illustrates an example of the conventional stacked state, when the number of times of the fold reinforcing is set to one time, the increased volume of the fold area remains due to the number and the thickness of sheets that form the bundle. When the number of times of the fold reinforcing is small (e.g., one time), since the thickness of each bundle of sheets can not be reduced sufficiently, the quantity of bundles of sheets that can be stacked on the stack tray 41 decreases. By contrast, when the number of times of the fold reinforcing increases, the quantity of bundles of sheets that can be stacked on the stack tray 41 can be increased, since the thickness of the fold area is decreased. However, when increasing the number of times of the fold reinforcing, the required time to reinforce the fold line naturally increases and the overall throughput for forming the booklets is lowered.

For this reason, as shown in FIG. 9B, the sheet finishing apparatus 20 according to the first embodiment adopts a measure that gives priority to throughput by decreasing the number of times of the fold reinforcing when the quantity of bundles of paper discharged to the stack tray 41 is small. On the other hand, the sheet finishing apparatus 20 makes the thickness of the bundles of paper as thin as possible by increasing the number of times of the fold reinforcing during operating when the quantity of bundles of paper is large.

Figure 10:
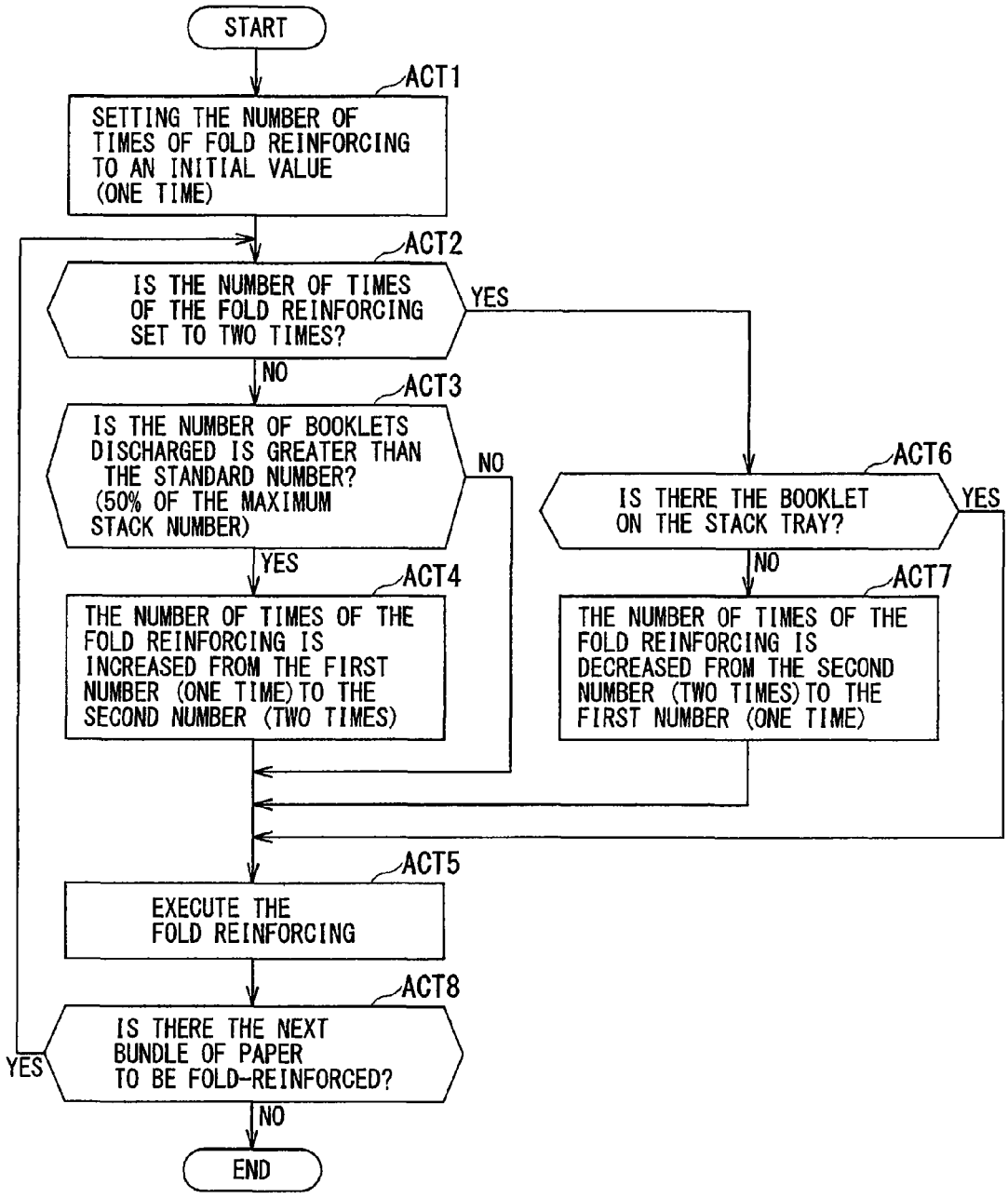
FIG. 10 is a flowchart illustrating an example of the fold reinforcing by the sheet finishing apparatus according to the first embodiment.

FIG. 10 is a flow chart illustrating an operation example of the sheet finishing apparatus 20 according to the first embodiment.

In ACT 1, the number of times of the fold reinforcing is set to the first number (for example, one time), as an initial value. If the number of times of the fold reinforcing is not set to the second number (meaning the number larger than the first number, for example, two times) (NO, in ACT 2), the booklet counter 43 is referred to. Then, it is determines whether the number of booklets discharged is greater than the standard number on the basis of count number of the booklet counter 43 (ACT 3). The standard number is the number with a certain ratio to the maximum stack number capable of being stacked on the stack tray 41 and is set to, for example, half of the maximum stack number.

When the quantity of the discharged bundles of paper is greater than the standard number, the number of times of the fold reinforcing is increased from the first number (one time) to the second number (two times) (ACT 4). Then, the fold reinforcing is performed according to the increased number of times (ACT 5).

When the fold reinforcing for the bundle of sheets needs to be consecutively performed (YES in ACT 8), the flow returns to ACT 2. If the number of times of the fold reinforcing has been increased to the second number (two times) at that time (YES in ACT 2), the flow proceeds to ACT 6.

In ACT 6, the presence of the booklet on the stack tray 41 is determined, based on the detection result of the sheet sensor 42. When there is no booklet on the stack tray 41 (NO in ACT 6), that is, when the users take all the booklets off the stack tray 41, the number of times of the fold reinforcing returns to the first number (one time) from the second number (two times), and the fold reinforcing is performed by one time. In addition, the booklet counter 43 is reset. On the other hand, when the booklets remain on the stack tray 41 (YES in ACT 6), two times of the fold reinforcing is continued.

In some cases, the total quantity of booklets to be formed is instructed in advance to the sheet finishing apparatus 20 from the main body of the image forming apparatus 1. In this case, when the total quantity of the booklets which is instructed is greater than the standard quantity (for example, about half of the maximum stack number), the fold reinforcing may be performed by presetting the number of times of the fold reinforcing to two times (the second number), without changing the number of times of the fold reinforcing from one time to two times during operation.

(3) Modified Example of the First Embodiment

The sheet sensor 42 detects the presence of booklets on the stack tray 41 but it does not detect the number of the booklets actually stacked on the stack tray 41. That is, the booklet counter 43 starts to count the number of booklets to be discharged to the stack tray 41 after the sheet sensor 42 detects that there are no booklets on the stack tray 41. Therefore, for example, even if a user takes off some booklets from the stack tray 41, the booklet counter 43 continues to count up the number assuming that there is no taking off from the booklets by the user if there remain one or more booklets on the stack tray 41. That is, a count value of the booklet counter 43 is just an estimated value of the number of booklets on the stack tray 41 from the number of the booklets discharged toward the stack tray 41 and may not insure that the count value is the number of booklets actually stacked on the stack tray 41.

In the modified example of the first embodiment, a technique is provided which estimates whether the number of stacked booklets indeed on the stack tray 41 is large or small, without depending on the booklet counter 43.

Figure 11:
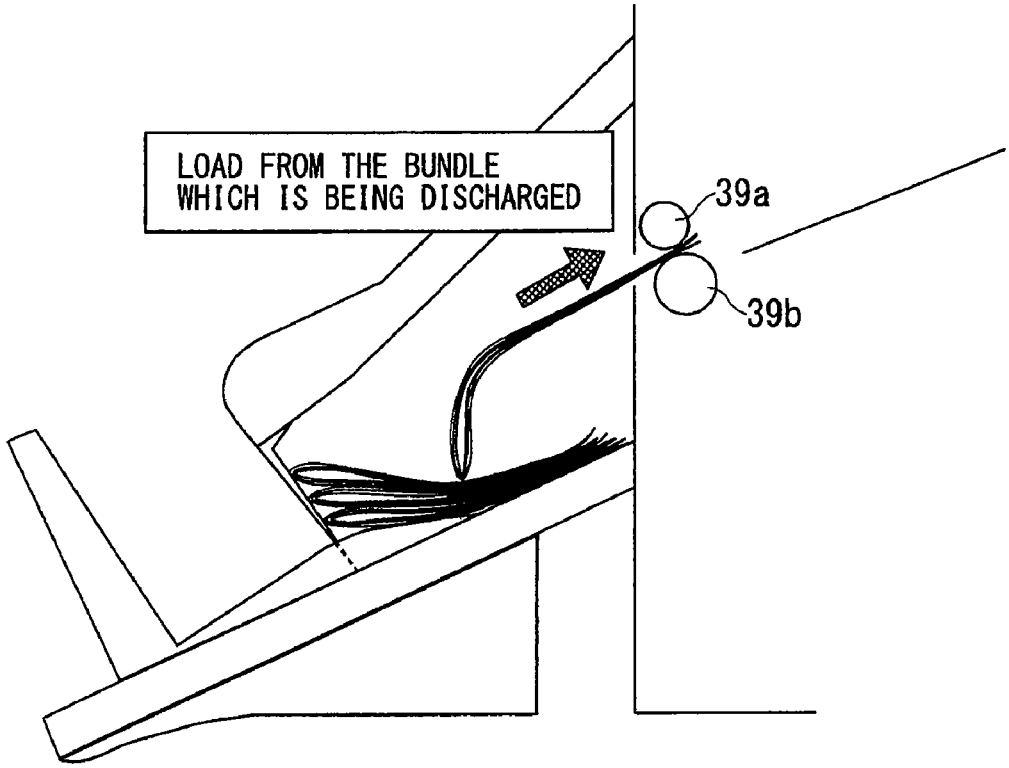
FIGS. 11, 12A and 12B are diagrams which describe an idling ratio of the sheet finishing apparatus according to a modified example of the first embodiment.
Figure 12A:
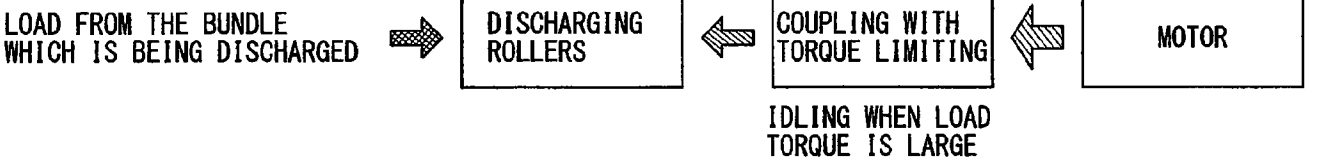
Figure 12B:
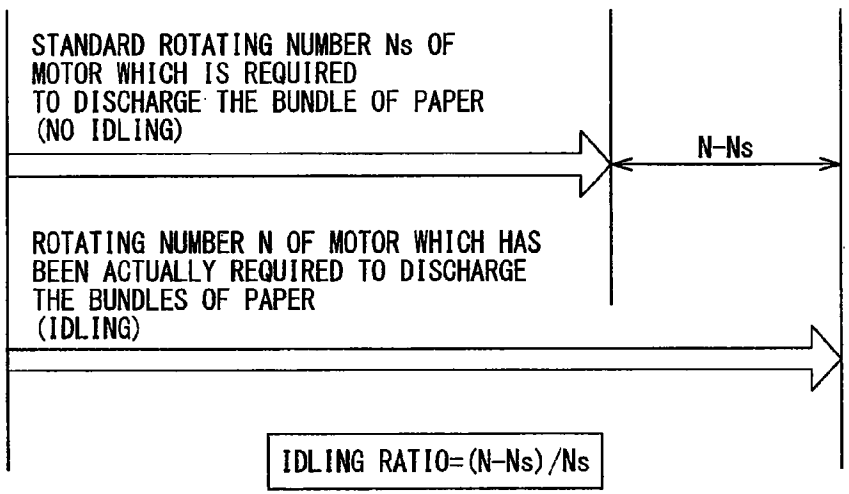

In FIGS. 11, 12A and 12B are diagrams which describe the concepts of the technique that estimate the quantity of stacked booklets on the stack tray 41.

As shown in FIG. 11, when the number of stacked booklets on the stack tray 41 increases, there is an occasion that the leading edge portion of the booklet, which is being discharged, bumps into the upper surface of the discharged booklets. As a result, with respect to the pair of discharging rollers 39*a* and 39*b*, reversing force is applied against the discharging direction. Therefore, load torque of the pair of discharging rollers 39*a* and 39*b* becomes large.

Meanwhile, as shown in FIG. 12A, between the pair of discharging rollers 39*a* and 39*b* and a discharging motor 46 which drives the pair of discharging rollers 39*a* and 39*b*, a coupling 47 having a torque limiting function is provided. The coupling 47 is originally provided to prevent accidents where a part of user's body such as fingers or the like or user's clothes is pressed into the pair of discharging rollers 39*a* and 39*b*, by idling to stop the rotation of the pair of discharging rollers 39*a* and 39*b*. Due to this torque limited properties of the coupling 47, when a load torque above a certain threshold level is applied to the pair of discharging rollers 39*a* and 39*b*, the coupling 47 idles between the pair of discharging rollers 39*a* and 39*b* and the discharging motor 46.

As the number of the stacked booklets increase and the leading edge portion of the discharged booklet bump into the upper surface of the booklets already discharged, the load torque of the pair of discharging rollers 39*a* and 39*b* becomes large and the degree of idling of the discharging motor 46 also becomes large.

Thus, in the modified example of the first embodiment, the degree of idling is calculated as an idling ratio, thereby estimating the quantity of the number of stacked booklets on the stack tray 41 depending on the degree of the idling ratio. Specifically, as shown in FIG. 12B, the idling ratio R is defined as "R=(N−Ns)/Ns", wherein a standard rotating number of the motor, which is required to discharge the bundles of paper when it is assumed that there is no idling, is "Ns", and a rotating number of the motor, which is actually required to discharge the bundles of paper is "N". Then, the number of times of fold reinforcing is controlled by estimating the quantity of the number of the stacked booklet on the stack tray 41 based on the idling ratio R.

Figure 13:
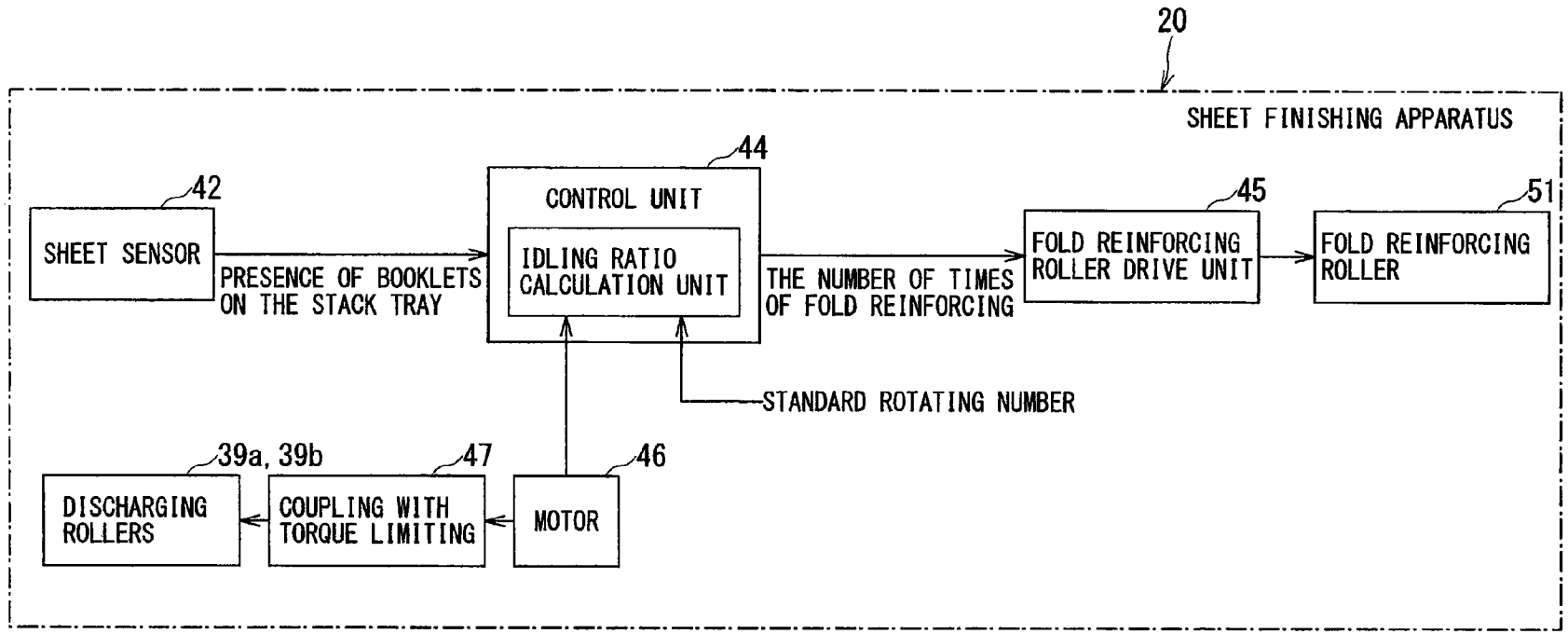
FIG. 13 is a function block diagram of the sheet finishing apparatus according to the modified example of the first embodiment.
Figure 14:
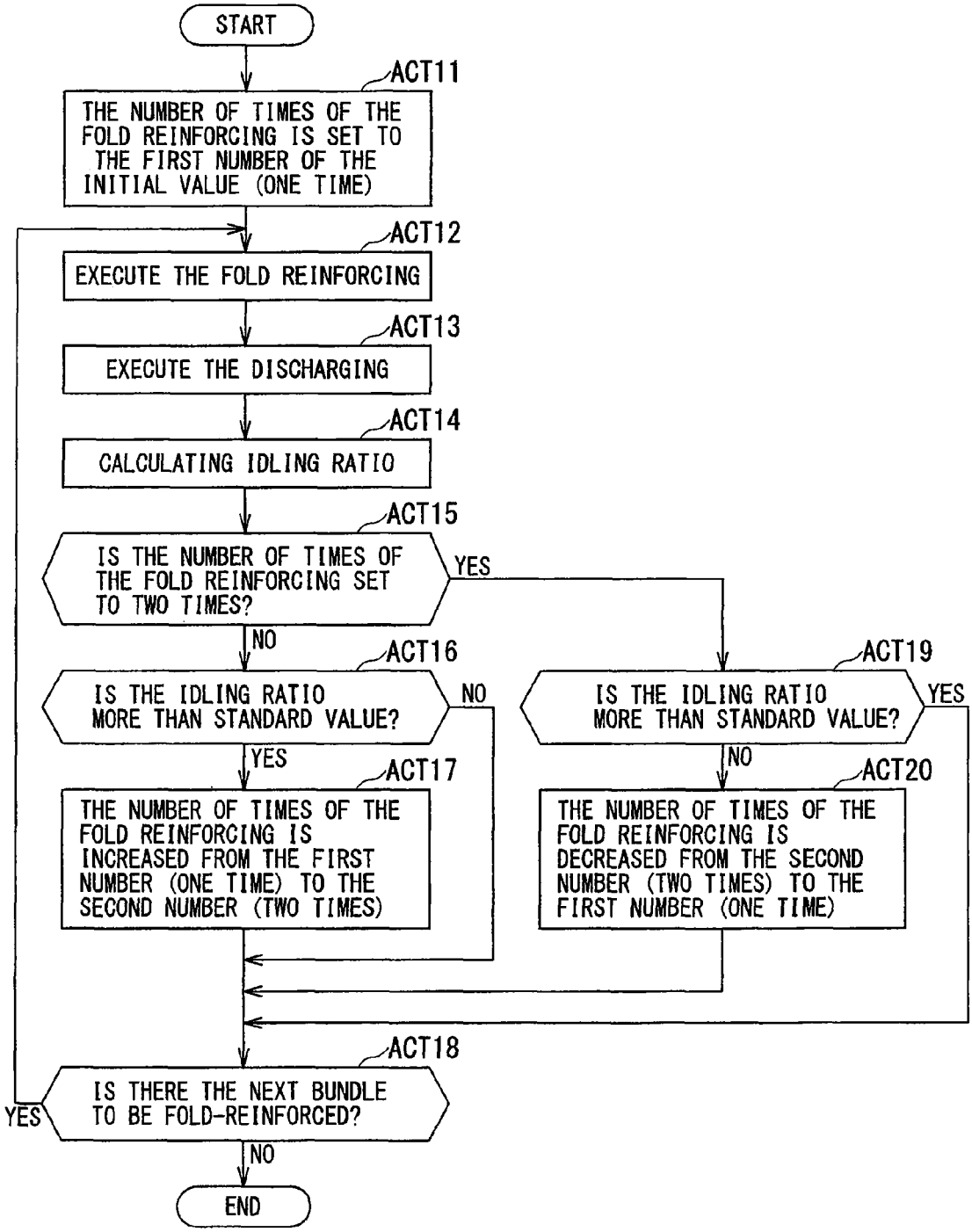
FIG. 14 is a flowchart illustrating an example of the fold reinforcing by the sheet finishing apparatus according to the modified example of the first embodiment.

FIG. 13 is a function block diagram relating to a basic operation of the sheet finishing apparatus 20 according to the modified example of the first embodiment. FIG. 14 is a flow chart illustrating an operation example of the sheet finishing apparatus 20 relating to the modified example of the first embodiment.

In ACT 11 in FIG. 14, the number of times of the fold reinforcing is set to the first number of the initial value (for example, one time). Subsequently, the set number of the fold reinforcing is performed to a bundle of sheets (in this case, one time) (ACT 12), and the pair of discharging rollers 39*a* and 30*b* discharges the bundle of sheets to the stack tray 41 (ACT 13). At this time, the number N of rotation of the motor 46 actually required to discharge the bundle of sheets is measured through, for example, encoder pulses of the discharging motor 46. After then, the idling ratio R is calculated by the expression described above using the measured rotation number N and the standard rotation number Ns (ACT 14).

If the number of times of the fold reinforcing is not the second number (for example, two times) (NO in ACT 15), that is, if the number of times of the fold reinforcing is the first number (for example, one time), the flow proceeds to ACT 16. In ACT 16, first, the calculated idling ratio R is compared with the standard value. When the idling ratio R is higher than the standard value, it is determined that the number of booklets on the stack tray 41 is large, and then, the number of times of the fold reinforcing is increased from the first number (one time) to the second number (two times).

On the other hand, when the idling ratio is lower than the standard value, it is determined that the number of booklets on the stack tray 41 is small, and then, the number of times of the fold reinforcing is maintained as the first number (one time)

(ACT 17). Although the standard value of the idling ratio R is not particularly limited, the value may be, for example, to 0.1 (i.e., 10%).

When the bundle of sheets to be fold reinforced still remains (YES in ACT 18), the flow returns to ACT 12.

When the number of times of the fold reinforcing is already increased to the second number (for example, two times) (YES in ACT 15), in ACT 19, the calculated idling ratio R is also compared with the standard value. When the idling ratio R is higher than the standard value, it is estimated that the number of booklets on the stack tray 41 is large. Thus, the number of times of the fold reinforcing is maintained as the second number which is already increased (two times). On the other hand, when the idling ratio is lower than the standard value, for example, due to the fact that a user takes off the booklets from the stack tray 41, it is estimated that the number of booklets on the stack tray 41 is small. In this case, the number of times of the fold reinforcing returns from two times to one time and the improvement of the throughput has priority.

In the modified example of the first embodiment, since the quantity of the number of the booklets actually stacked on the stack tray 41 is estimated without depending on the booklet counter 43, the number of times of the fold reinforcing can be effectively controlled even when the user takes off the booklets from the stack tray 41.

(4) Second Embodiment

In the first embodiment, switch of the number of times of the fold reinforcing is performed based on the number of stacked booklets on the stack tray 41. In addition, the number of times of the fold reinforcing is controlled at two stages of the first number (for example, one time) and the second number (for, example, two times).

In contrast to this, in the second embodiment, the switch of the number of times of the fold reinforcing is performed based on a total number of sheets of the booklets, which is a sum of sheets of all of the booklets, not based on the number of booklets. In addition, it is also configured to be possible to reinforce the fold line at multiple stages not only at two stages.

Figure 15:
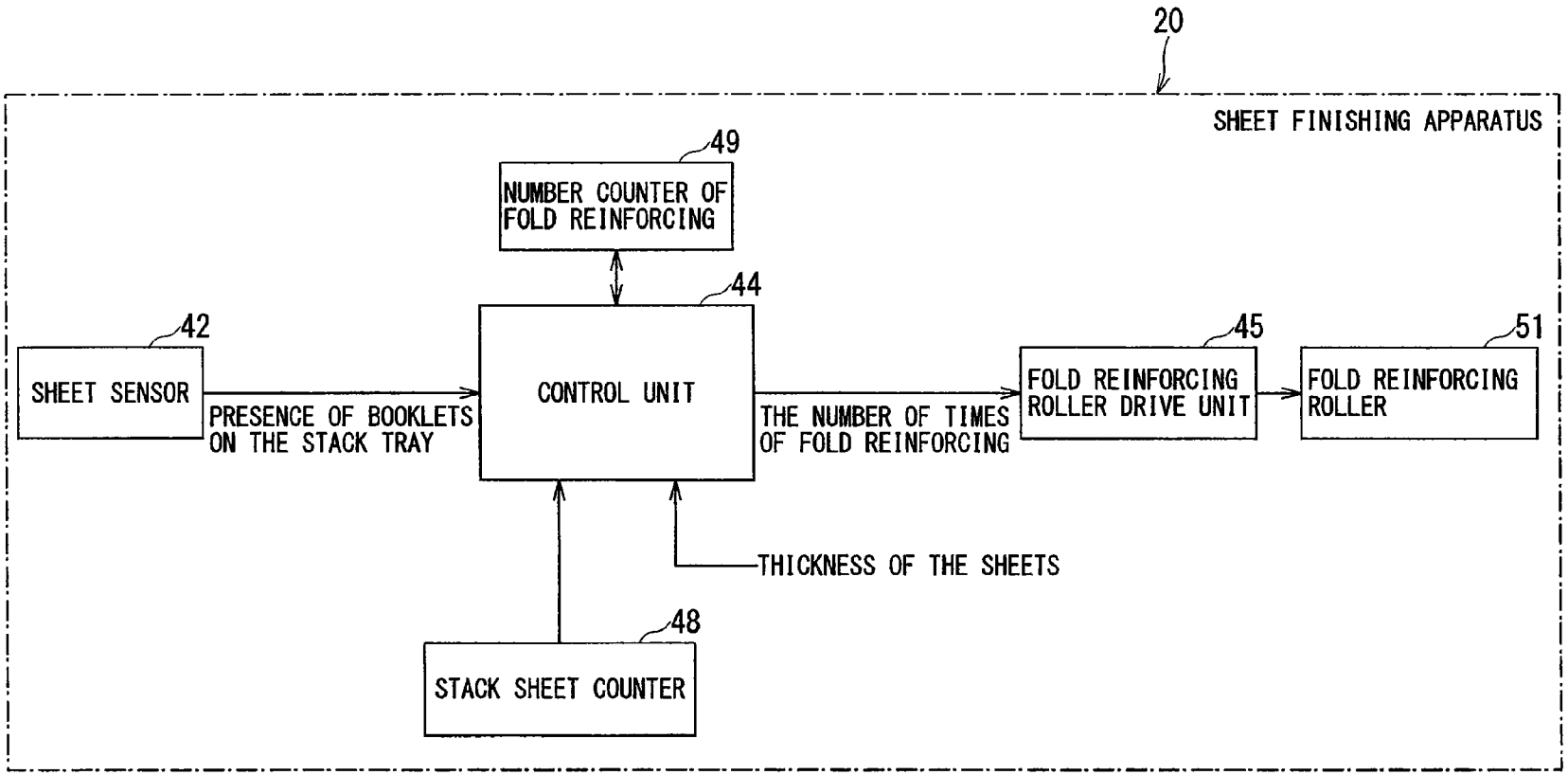
FIG. 15 is a function block diagram of the sheet finishing apparatus according to a second embodiment.

FIG. 15 is a function block diagram relating to a basic operation of the sheet finishing apparatus 20 according to the second embodiment. The sheet finishing apparatus 20 according to the second embodiment includes a stack sheet counter 48 and a number counter of fold reinforcing 49, in addition to the sheet sensor 42, the control unit 44, the fold reinforcing roller drive unit 45 and the fold reinforcing rollers 51.

Figure 16:
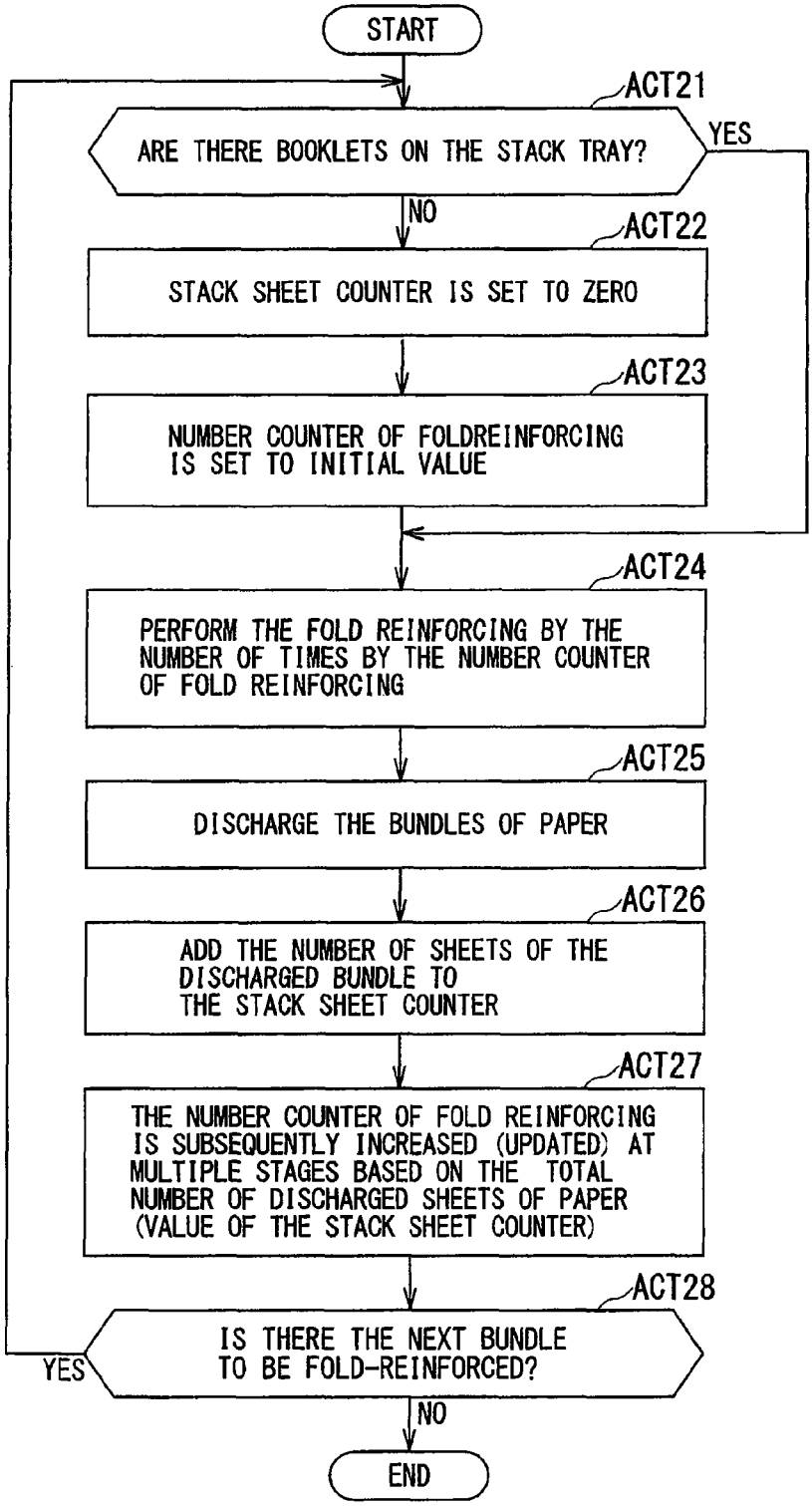
FIG. 16 is a flow chart illustrating an example of fold reinforcing by the sheet finishing apparatus according to the second embodiment.

FIG. 16 is a flow chart illustrating an operation example of the sheet finishing apparatus 20 according to the second embodiment.

In ACT 21, the presence of the booklets on the stack tray 41 is determined in accordance with the detection result of the sheet sensor 42. When at least one booklet is detected on the stack tray 41, the flow proceeds to ACT 24. When no booklet is detected on the stack tray 41, the stack sheet counter 48 is set to zero (ACT 22), and the number counter of fold reinforcing 49 is set to an initial value (ACT 23). The initial value is the same as the first number of the first embodiment, for example, the value is set to one time.

ACT 24 performs the fold reinforcing which is performed based on the same number of fold reinforcing as the count value that is currently set by the number counter of fold reinforcing 49.

When a bundle of sheets is discharged after finishing the fold reinforcing (ACT 25), the number of sheets included in the discharged bundle is added to the stack sheet counter 48 (ACT 26). That is, the count value of the stack sheet counter 48 is the total number of sheets which are included in all the booklets stacked on the stack tray 41.

In ACT 27, the count value of the number counter of fold reinforcing 49 is subsequently increased (updated) at multiple stages based on the total number of discharged sheets of the booklets (the counter value of the stack sheet counter 48). For example, if the total number of the discharged sheets of paper is in a range of 0 to 300 pages, the count value of the number counter of fold reinforcing 49 is set to one time, if in a range of 301 to 600 pages, it is set to two times, and if in a range of 601 to 900 pages, it is set to three times, and so forth. As above, the count value of the number counter of fold reinforcing 49 is updated. If there further remain the bundles of sheets to be reinforced, the flow returns to ACT 21 and the same process is repeated.

According to the second embodiment, the number of times of the fold reinforcing of the fold reinforcing rollers 51 is set at multiple stages based on the total number of discharged sheets, thereby obtaining the more detailed controlling than the first embodiment.

In addition, when the sheet included in the bundle is thicker than a standard sheet, the number of the sheet may be counted as the plural numbers of the standard sheet. As a result, the number of times of the fold reinforcing is increased with respect to the bundle having thick sheets, compared to the booklet having the same pages of the standard sheets. As a result, the increase of the thickness of the booklet due to the thicker sheet can be suppressed.

(5) Third Embodiment

Figure 17:
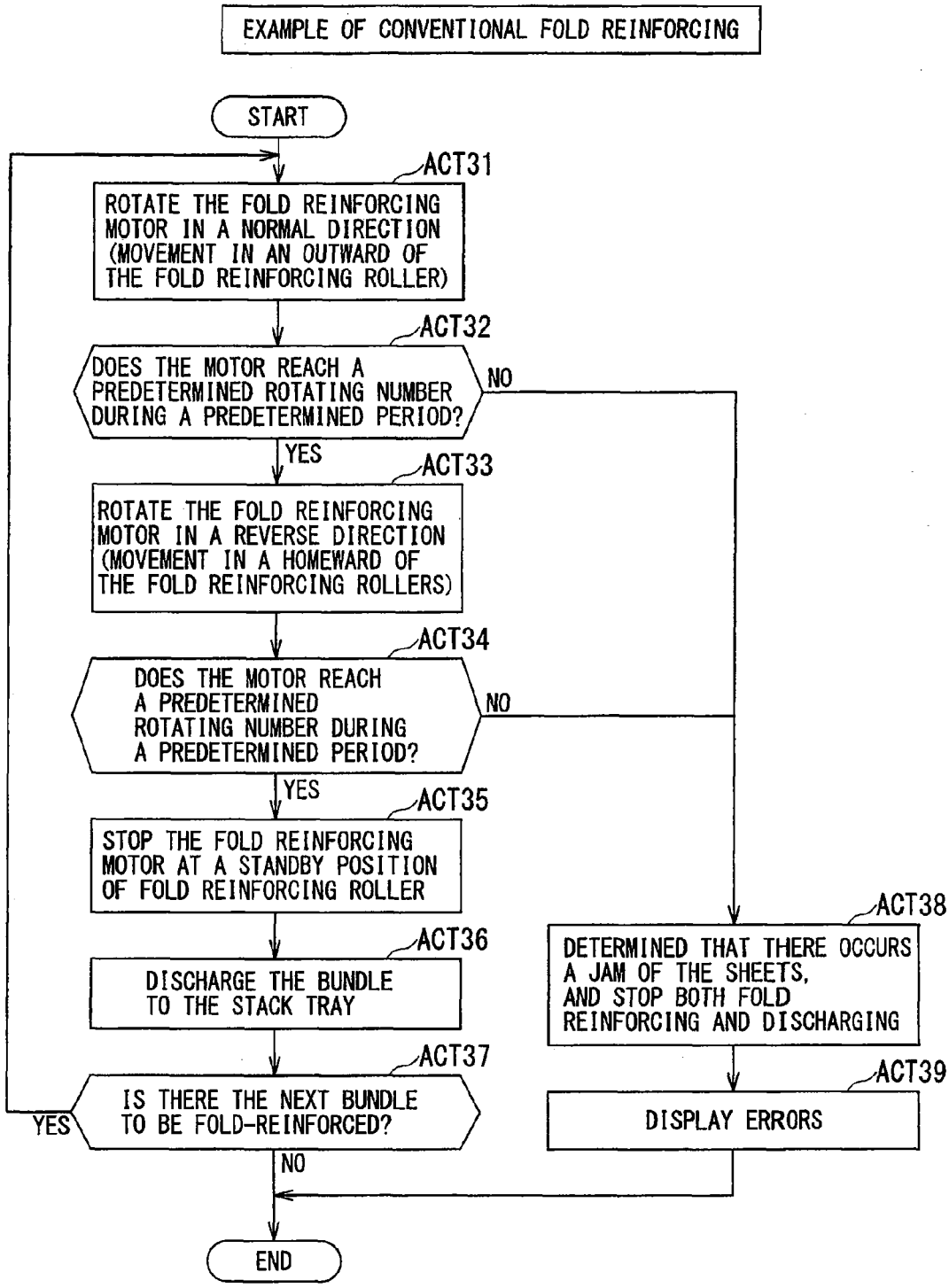
FIG. 17 is a flow chart illustrating an example of an existing fold reinforcing process as a comparison example with respect to a third embodiment.

FIG. 17 is a flow chart illustrating an example of conventional fold reinforcing to compare to fold reinforcing of the sheet finishing apparatus 20 according to third embodiment.

As described above, first, the fold reinforcing motor in the fold reinforcing roller drive unit 45 rotates in a normal direction and moves the fold reinforcing rollers 51 from a standby position along the fold line in an outward direction (ACT 31). Then, after starting the movement in the outward direction, the rotating number of the fold reinforcing motor is monitored to determine whether the rotating number of the fold reinforcing motor reaches a predetermined rotating number during a predetermined period (ACT 32). When the number reaches the predetermined rotating number without troubles, the fold reinforcing rollers 51 reach the standby position opposite to an initial standby position. Then, the fold reinforcing motor is reversely driven and moves the fold reinforcing rollers 51 in a homeward direction (ACT 33). Similarly, after starting the movement in the homeward direction, the rotating number of the fold reinforcing motor is monitored to determine whether the rotating number of the fold reinforcing motor reaches a predetermined rotating number during a predetermined period (ACT 34). When the number reaches the predetermined rotating number without troubles, the fold reinforcing rollers 51 return to the initial standby position and the fold reinforcing motor stops (ACT 35). The bundle of sheets, of which the fold line is reinforced, is discharged to the stack tray 41 (ACT 36). When there still remain the bundles to be fold reinforced (YES in ACT 37), the flow returns to ACT 31 and the same process is repeated.

Meanwhile, in the determination in ACT 32 or ACT 34, when the rotating number of the fold reinforcing motor does not reach the predetermined rotating number during the predetermined period after starting the movement of the fold reinforcing rollers 51, it is determined that there occurs paper jamming due to some reasons, and then the fold reinforcing is stopped. That is, the fold reinforcing rollers 51 is stopped at the operating position. In addition, the rotation of the pair of folding rollers 38 and the pair of discharging rollers 39*a* and 39*b* is stopped, and the discharge of the bundles of paper is further stopped (ACT 38). Then, an error is displayed to urge the users to perform the restoration operation (ACT 39). The above mentioned processes have been conventionally performed.

However, it should be noted that the reasons that the rotating number of the fold reinforcing motor does not reach the predetermined rotating number during the predetermined period are not always caused by the occurrence of the paper jamming. For example, in some cases, the error occurs simply by the increased load applied on the fold reinforcing rollers 51 due to the thickness of the bundles of paper, which is thicker than the predetermined value. In this case, although the reinforcing of the fold may not be sufficiently performed, the fold itself is already formed by the pair of folding rollers 38. In the related art, even in this case, the apparatus stops the whole operation and causes the users perform the restoration operation thereby causing a great deal of operation to be made by the users.

Therefore, the sheet finishing apparatus 20 according to the third embodiment is configured to reduce the great deal of operation burden mentioned above.

Figure 18:
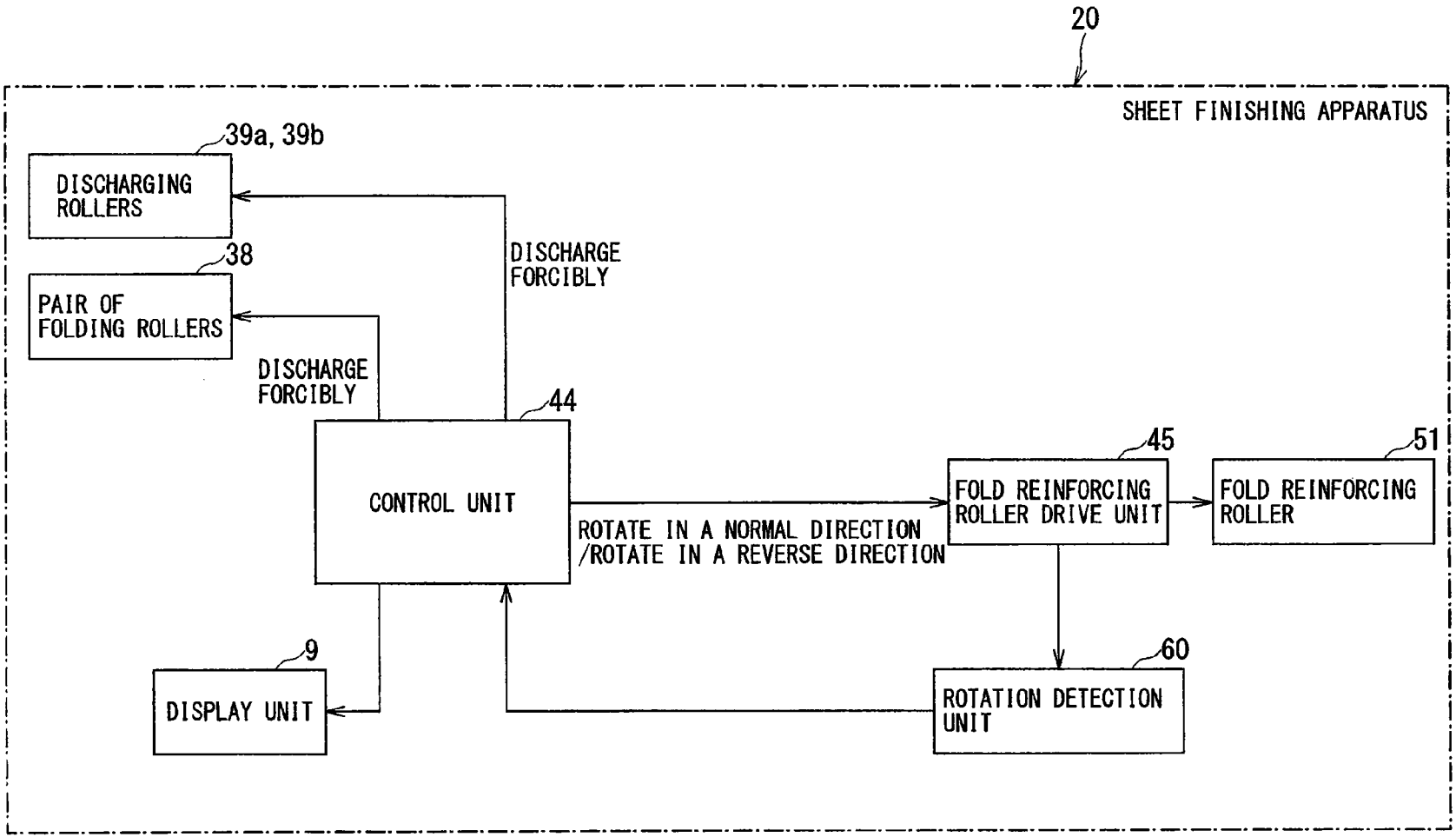
FIG. 18 is a function block diagram of the sheet finishing apparatus according to the third embodiment.

FIG. 18 is a functional block diagram relating to a basic operation of the sheet finishing apparatus 20 according to the third embodiment. In the sheet finishing apparatus 20 according to the third embodiment, the fold reinforcing roller drive unit 45 includes a rotation detection unit 60 that detects the rotating number of the fold reinforcing motor. The rotation detection unit 60 is configured to the conventional configuration however the application of the detected result is different from the conventional configuration.

Figure 19:
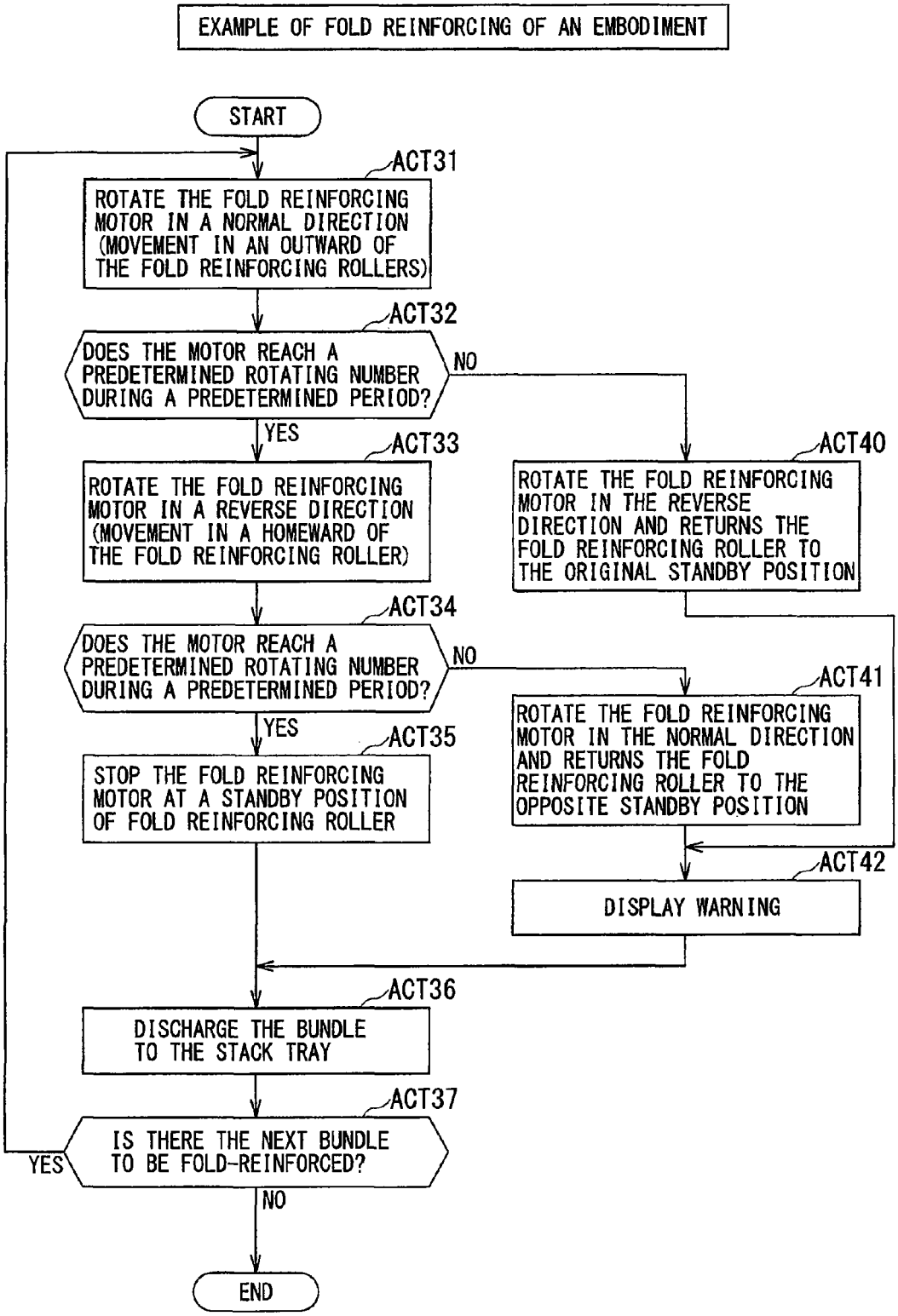
FIG. 19 is a flow chart illustrating an example of the fold reinforcing by the sheet finishing apparatus according to the third embodiment.

FIG. 19 is a flow chart illustrating an operation example of the sheet finishing apparatus 20 according to the third embodiment.

The difference from the conventional configuration is processes of ACT 40 to ACT 42. In the third embodiment, when the rotating number of the fold reinforcing motor does not reach the predetermined rotating number during the predetermined period, the fold reinforcing motor rotates in the reverse direction and the fold reinforcing rollers 51 return to the position before starting the movement. During the operation on the outward way, the fold reinforcing motor switches the direction of rotation from the normal direction to the reverse direction and returns to the original standby position (ACT 40). During the operation on the homeward way, the fold reinforcing motor switches the direction of rotation from the reverse direction to the normal direction and returns to the standby position of the opposite side (ACT 41). Either position does not interrupt the discharge of the bundles of paper by the fold reinforcing rollers 51. After the fold reinforcing rollers 51 return to either standby position, the notification for notifying the process to user is displayed (ACT 42). Then the bundles of paper are discharged to the stack tray 41 (ACT 36). The reinforcing of the fold on such bundles of paper may not be sufficiently performed, however the forming the fold itself is performed by the pair of folding rollers 38.

In the sheet finishing apparatus 20 according to the third embodiment, the bundles of paper of which the fold is formed may be discharged to the stack tray 41 before causing the shutdown of the apparatus, thereby reducing the great deal of operation burden to the users.

While certain embodiments have been described, these embodiments have been presented by way of example only, and are not intended to limit the scope of the invention. Indeed, the novel apparatuses and units described herein may be embodied in a variety of other forms; furthermore, various omissions, substitutions and changes in the form of the apparatuses and units described herein may be made without departing from the spirit of the invention. The accompanying claims and their equivalents are intended to cover such forms or modifications as would fall within the scope and spirit of the invention.

What is claimed is:

1. A sheet finishing apparatus comprising:

a folding roller that nips the middle of a bundle of sheets and form a fold line;

a fold reinforcing roller that reinforces the fold line of the bundle by moving along the fold line while applying a pressure to the fold line;

a stack tray that stacks the bundle of which the fold line is reinforced; and a control unit that sets the number of times of fold reinforcing performed by the fold reinforcing roller as a first number when it is determined that a quantity of bundles of sheets stacked on the stack tray is less than a predetermined standard quantity which is set to be less than a maximum stack quantity, and sets the number of times of the fold reinforcing as a second number greater than the first number when it is determined that a quantity of the stacked bundles of sheets is greater than the predetermined standard quantity.

2. The apparatus according to claim 1, further comprising:

a sensor that is provided in the stack tray and detects presence of the bundles stacked on the stack tray; and a booklet counter that counts the quantity of the bundles discharged toward the stack tray, wherein the predetermined standard quantity is a predetermined standard number of the stacked bundles, wherein the control unit increases the number of times of the fold reinforcing from the first number to the second number, when a count number of the bundles by the booklet counter is greater than the predetermined standard number, after the sensor detects that there are no bundles of paper on the stack tray.

3. The apparatus according to claim 2, wherein when the sensor detects that there are no bundles of paper on the stack tray after the number of the stacked bundles on the stack tray becomes greater than the predetermined standard number, the control unit returns the number of times of the fold reinforcing from the second number to the first number.

4. The apparatus according to claim 2, wherein the standard number is substantially half of the maximum stack number of the bundles.

5. The apparatus according to claim 1, wherein the number of times of the fold reinforcing is a number of times that the fold reinforcing rollers reciprocate once along the fold line.

6. The apparatus according to claim 5, wherein the first number is one time and the second number is two times.

7. The apparatus according to claim 1, wherein after the quantity of the stacked bundles on the stack tray reaches the predetermined standard quantity, the control unit changes the number of times of the fold reinforcing from the first number to the second number, when the bundles of paper are consecutively discharged to the stack tray.

8. The apparatus according to claim 1, wherein the control unit sets the number of times of the fold reinforcing to the second number from the start when the quantity of the stacked bundles on the stack tray is instructed in advance to be greater than the predetermined standard quantity.

9. The apparatus according to claim 1, further comprising:

a discharging roller that discharges the bundles of sheets toward the stack tray;

a motor that drives the discharging roller; and a coupling that carries a rotation of the motor to the discharging roller and idles when a load above a certain level is applied to the discharging roller, wherein the control unit:

calculates an idling ratio in a period when the discharging rollers is discharging the bundle, sets the number of times of the fold reinforcing to the first number when the idling ratio is lower than a predetermined standard value, and sets the number of times of the fold reinforcing to the second number when the idling ratio is higher than the predetermined standard value.

10. The apparatus according to claim 9, wherein the idling ratio R is represented as "R=(N−Ns)/Ns", wherein a standard rotating number of the motor, which is required to discharge the bundle when it is assumed that there is no idling, is "Ns", and a rotating number of the motor, which is actually required to discharge the bundle is "N".

11. The apparatus according to claim 1, wherein the predetermined standard quantity is a total number of sheets of all the bundles stacked on the stack tray, wherein the control unit sets the number of times of the fold reinforcing in accordance with the total number of sheets of all the bundles.

12. The apparatus according to claim 11, further comprising:

a paper counter that counts the total number of sheets of all the bundles; and a number counter that designates the number of times of the fold reinforcing, and wherein the control unit increases a count value of the number counter depending on the increase of a count value of the paper counter, and sets the second number of the fold reinforcing to the number at multiple stages based on the count value of the number counter.

13. The apparatus according to claim 12, further comprising:

a sensor that is provided in the stack tray and detects presence of the stacked bundles of paper on the stack tray, wherein, when the sensor detects that there are no bundles on the stack tray, the control unit sets the count value of the paper counter to zero and sets the number counter to the first number.

14. The apparatus according to claim 11, wherein when the bundle includes a thicker sheet than a standard sheet, the control unit counts the number of the thicker sheet as plural sheets of the standard sheet.

15. The sheet finishing apparatus comprising:

a folding roller that nips the middle of bundle of sheets and forms a fold line;

a fold reinforcing roller that reinforces the fold line of the bundle by moving along the fold line while applying a pressure to the fold line;

a stack tray that stacks the bundles of which the fold is reinforced;

a motor that drives the fold reinforcing roller;

a rotating detection unit that detects a rotating number of the motor; and a control unit that moves the fold reinforcing rollers in a reverse direction when the rotating number, which is detected by the rotating detection unit, does not reach a predetermined rotating number after a certain time is passed, controls the motor to be on standby at a position where the discharge of the bundle is not interrupted, and discharges the bundles of paper to the stack tray forcibly.

16. The apparatus according to claim 15, further comprising a display unit, wherein, when the bundle is discharged to the stack tray forcibly on the way of reinforcing the fold line, the display unit displays a warning.

17. A sheet finishing method comprising:

forming a fold by nipping the middle of bundle of sheet with a folding roller;

reinforcing the fold line of the bundle by moving a fold reinforcing roller along the fold line while applying a pressure to the fold line with the fold reinforcing roller;

stacking the bundle of which the fold line is reinforced on a stack tray; and setting a number of times of fold reinforcing performed by the fold reinforcing roller to a first number when it is determined that a quantity of stacked bundle on the stack tray is less that a predetermined standard quantity which is set to be less than a maximum stack quantity, and setting a number of times of the fold reinforcing performed by the fold reinforcing roller to a second number greater than the first number when it is determined that the quantity of stacked bundle is greater than the predetermined standard quantity.

18. The method according to claim 17, further comprising:

detecting presence of the stacked bundle on the stack tray with a sensor provided therein; and counting the number of bundles which is discharged to the stack tray with a booklet counter, wherein the predetermined standard quantity is a predetermined standard number of the bundle, and wherein in the setting, the number of times of the fold reinforcing is increased from the first number to the second number, when a count number of the bundles by the booklet counter is greater than the predetermined standard number, after the sensor detects that there are no bundles of paper on the stack tray.

19. The method according to claim 17, further comprising:

discharging the bundle toward the stack tray with discharging rollers;

driving the discharging roller with a motor;

carrying a rotation of the motor to the discharging roller with a coupling;

idling the coupling when a load above a certain level is applied to the discharging roller; and calculating an idling ratio during discharging the bundle by the discharging rollers, wherein in the setting, the number of times of the fold reinforcing is set to the first number when the idling ratio is lower than a predetermined standard value, and the number of times of the fold reinforcing is set to the second number when the idling ratio is higher than a predetermined standard value.

20. The method according to claim 17, wherein the predetermined standard quantity is a total number of sheets of all the bundles stacked on the stack tray, wherein in the setting, the number of times of the fold reinforcing is set at multiple stages in accordance with the total number of sheets.

* * * * *